United States Patent [19]

Mangels

[11] 4,437,195

[45] Mar. 20, 1984

[54] SELF-INFLATING BEDPAN

[76] Inventor: Ralph W. Mangels, 345 N. Arizona Ave., Chandler, Ariz. 85224

[21] Appl. No.: 351,128

[22] Filed: Feb. 22, 1982

[51] Int. Cl.[3] ..... A61H 9/00

[52] U.S. Cl. ..... 4/456; 4/450; 4/451; 4/455

[58] Field of Search ..... 4/451, 456, 450, 455

[56] References Cited

U.S. PATENT DOCUMENTS

| | | | |
|---|---|---|---|
| 3,008,153 | 11/1961 | Coulter | 4/456 X |
| 3,513,488 | 5/1970 | Oring et al. | 4/451 |
| 3,546,717 | 12/1970 | Kuhn | 4/451 |
| 3,579,654 | 5/1971 | Kuhn | 4/451 |
| 3,605,128 | 9/1971 | Oden et al. | 4/451 |
| 3,609,771 | 10/1971 | Avoy | 4/451 |
| 3,628,197 | 12/1971 | Leventhal | 4/451 |
| 3,848,274 | 11/1974 | Olivan | 4/456 |

*Primary Examiner*—Henry K. Artis

*Attorney, Agent, or Firm*—Drummond & Nissle

[57] ABSTRACT

A self-inflating bedpan having means for readily, manually inflating the bedpan after it is positioned beneath a patient.

6 Claims, 7 Drawing Figures

FIG. 1
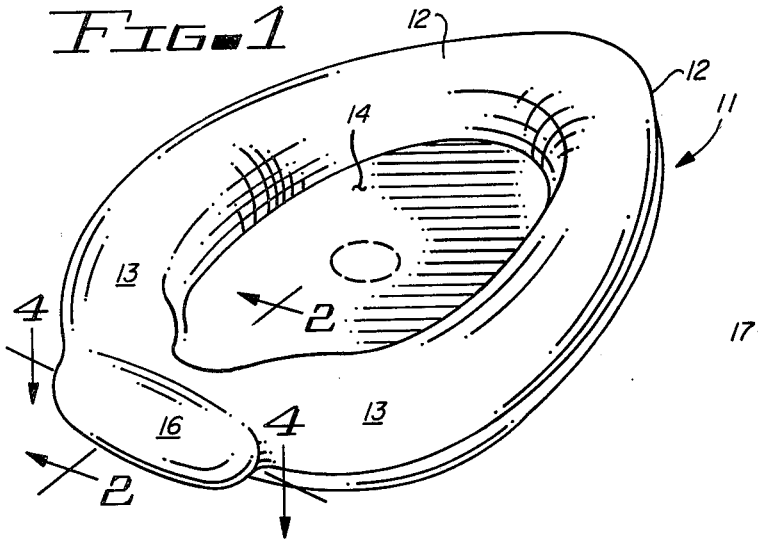
FIG. 2
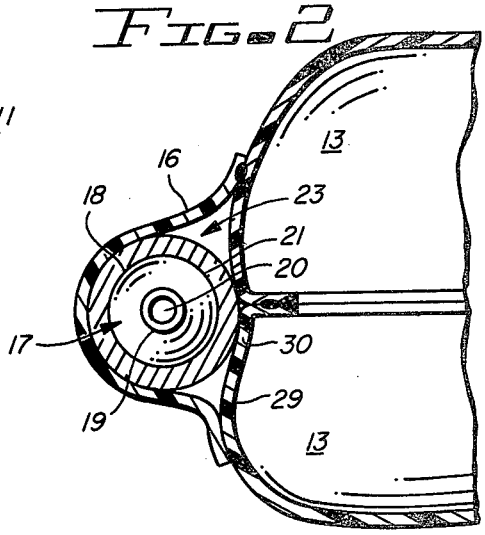
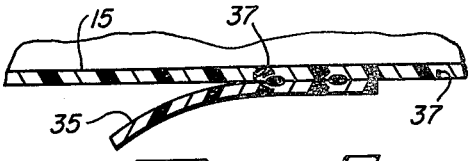
FIG. 5
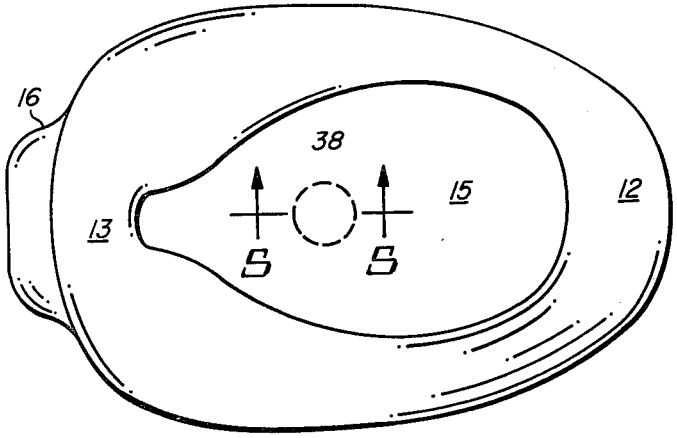
FIG. 3
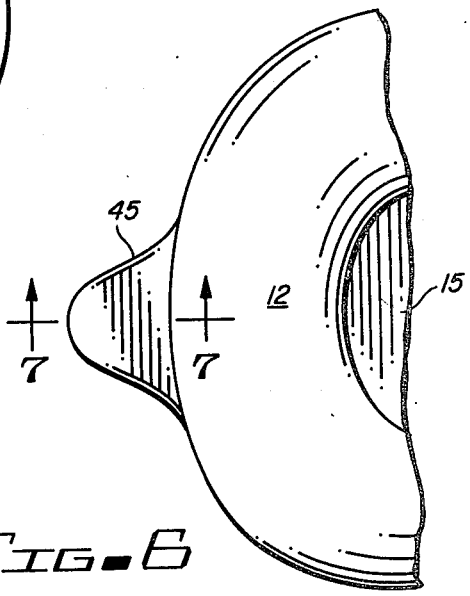
FIG. 6
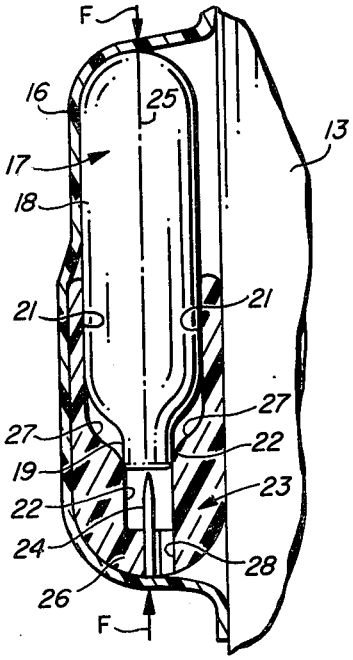
FIG. 4
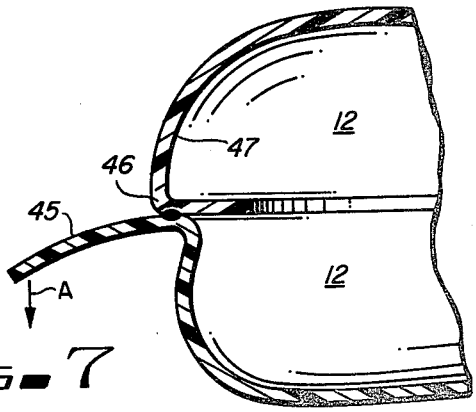
FIG. 7

SELF-INFLATING BEDPAN

This invention relates to inflatable, disposable bedpans.

More particularly, the invention pertains to inflatable bedpans which each include a self-contained mechanism for inflating the bedpan.

In another respect the invention concerns inflatable bedpans which require that a bedridden patent only need be moved a minimal amount to properly position the bedpan underneath the sacrococcygeal area of the patient.

In a further respect, the invention pertains to an inflatable bedpan having a self-contained inflating mechanism which can be readily activated after the uninflated bedpan is positioned underneath a bedridden patient.

In still another and more particular respect, the invention pertains to an inflatable bedpan in which the inflating mechanism is easily manually activated by nurses or medical attendants having limited hand strength.

Inflatable, disposable bedpans are well known in the art. See, for example, U.S. Pat. Nos. 3,513,488 to Oring; 3,605,127 to Dailey; 4,207,633 to Smith; 3,609,771 to Avoy; 2,466,142 to Yost; 2,750,600 to MacDonald; and 3,728,744 to Kimbro. Drawbacks associated with economy of production and practicality of use have resulted in the bedpans described in these issued patents being commercial white elephants. Use of these bedpans is, if they are currently utilized at all, apparently extremely limited.

One problem with many of the prior art bedpans is that they must be inflated before they are positioned beneath a bedridden patient. If the patient is paralyzed or experiences pain on movement onto the bedpan, the patient normally must have two or more attendants lift his hips high enough to allow the insertion of the bedpan under the buttocks or must have the attendants turn him to one shide before placing the bedpan under the buttocks and then rotating him back to the supine position. Either of these procedures may cause extreme discomfort to patients who have fractures of the spine, pelvis, hips or upper legs and who experience pain during sudden or irregular movement. Paralyzed patients, many of whom may have accumulated considerable weight around the hip area, are quite difficult to lift onto a bedpan. More than one attendant is usually required and the attendants, each positioned on one side of the bed, must lean over the bed such that the muscles of their backs rather than their arm muscles are primarily used for lifting the pateint; hence, attendants must possess considerable strength to successfully repeatedly raise a patient from the bed to insert or remove a bedpan. Nonambulatory patients who might be cared for at home are often placed in nursing homes largely because their families are unable to cope with their toilet needs.

Further problems of existing inflatable bedpans are associated with the activation of self-contained mechanisms which provide the gas which inflates the plastic or other resilient material forming the inflatable chambers of the bedpan. U.S. Pat. No. 3,571,654 described a bedpan in which fluid is added to chemicals contained in the inflatable chamber of a bedpan. The reaction between the chemicals and water produces a gas which inflates the bedpan. This procedure, both in connection with the storage of and dispensing of the fluid used, is messy and is simply impractical in caring for a large number of hospitalized patients.

In the inflatable bedpan disclosed in the Oring patent (U.S. Pat. No. 3,513,488), a cannister of compressed gas is carried in the ring-shaped inflatable chamber of the bedpan (See FIGS. 4, 7, 8). When lever 36 of cannister 26 is depressed, gas released from the cannister inflates the bedpan. Cannister 26 is not attached to or positioned in a given orientation inside the flexible material forming the inflatable ring-shaped chamber of the bedpan and an individual using the bedpan must first locate and properly orient cannister 26 before lever 36 can be depressed. When lever 36 is depressed nub 40, in addition to forcing pin nub 34 and the pin towards membrane 30, pushes nub 34 downwardly toward the bottom of cylinder 26 and tends to skew the pin in relation to the wall slidably supporting the pin. The tendency of the pin to skew in the supporting wall increases the friction between the pin and wall when the pin slides through the wall and, consequently, increases the manual strength required to depress lever 36, pierce membrane 30 with the pin and release gas from chamber 28 of cannister 26. For a nurse to position the uninflated bedpan described in Oring beneath a bedridden patient and then depress lever 36 to inflate the bedpan, cannister 26 must be manually located, properly positioned in the inflatable chamber at one end of the bedpan and properly oriented in the inflatable chamber and hand of the nurse. Since attempting to move cannister 26 in the uninflated chamber of the bedpan is difficult, this procedure is time consuming and awkward at best.

Accordingly, it would be highly desirable to provide an improved disposable, inflatable bedpan having a self-contained source of pressurized gas which would permit the bedpan to be readily positioned beneath a nonambulatory patient while uninflated.

It would also be highly desirable to provide an improved inflatable bedpan of the type described above which would include a self-contained source of pressurized gas which could be readily and conveniently manually activated after the uninflated bedpan has been properly positioned beneath the sacrococcygeal area of a patient.

Therefore, it is a principal object of the present invention to provide an improved disposable, inflatable bedpan.

Another object of the invention is to provide an improved inflatable bedpan which can be easily properly positioned beneath a bedridden patient before the bedpan is inflated.

A further object of the instant invention is to provide an improved inflatable bedpan having a self-contained source of pressurized gas which can be quickly and conveniently activated to inflate the bedpan after the bedpan is positioned beneath a bedfast patient.

Another, further and more specific object of the invention is to provide an inflatable bedpan having a self-contained source of pressurized gas for inflating the bedpan, the source of pressurized gas being manually activable by nurses or medical attendants having limited hand strength.

Still a further object of the invention is to provide an improved inflatable bedpan having a self-contained source of pressurized gas used to inflate the bedpan, the source of pressurized gas including a reliable manually operable mechanism for releasing the gas which is readily located by a nurse or attendant utilizing the inflatable bedpan after the uninflated bedpan has been positioned beneath a bedfast patient.

Yet another object of the invention is to provide an improved inflatable bedpan having means for removing any excrement collected in the bedpan.

These and other, further and more specific objects and advantages of the invention will be apparent to those skilled in the art from the following detailed description thereof, taken in conjunction with the drawings, in which:

FIG. 1 is a perspective view of an inflatable bedpan constructed in accordance with the principles of the invention and representing the presently preferred embodiment and best mode of the invention;

FIG. 2 is a sectional elevation view of a portion of the inflatable bedpan of FIG. 1 taken along section line 2-2 thereof and further illustrating interior construction details thereof;

FIG. 3 is a top view of the inflatable bedpan of FIG. 3;

FIG. 4 is a top sectional view of a portion of the compressed gas inflating mechanism of the inflatable bedpan of FIG. 1 taken along section line 4-4 thereof;

FIG. 5 is a sectional view of the inflatable bedpan of FIG. 3 taken along section line 5-5 thereof and illustrating the tear away tab utilized to drain collected fluid from the bedpan;

FIG. 6 is a top view of the inflatable, disposable bedpan of FIG. 1 fabricated to include an optional tear away tab for deflating the bedpan; and FIG. 7 is a side sectional view of the bedpan of FIG. 6 taken along section line 7-7.

Briefly, in accordance with my invention, I provide an improved disposable, self-inflatable bedpan. The bedpan includes a closed, rings-shaped, flexible and inflatable portion constructed from a fluid imprevious material to produce a curved pan-shaped configuration when the portion is inflated, the ring-shaped portion enclosing and defining an interior area and having a first end generally positioned beneath the sacrococcygeal area of a bedfast patient, and having a second end generally positioned beneath the legs of the bedfast patient; a fluid imprevious flexible panel connected to the ring-shaped portion and spanning the interior area thereof such that when the ring-shaped portion is inflated a self-supporting fluid-tight reservoir having a continuous upstanding wall for collecting and retaining bodily excrement is formed; means carried by the bedpan for producing gas for inflating the inflatable ring-shaped portion of the bedpan; and means for manually activating the inflatable means. The activating means is generally fixedly positioned on the second end of the inflatable bedpan.

The inflating means may be positioned on the second end of the inflatable bedpan such that gas produced thereby flows into the inflatable portion.

The inflating means may comprise a compressed gas container including a hollow body having a generally cylindrical outer wall and containing pressurized gas, a generally circular hollow neck connected to and in fluid communication with said cylindrical body and having a seal formed in the hollow thereof to prevent the pressurized gas from escaping from the container through said neck, and means for manually piercing the seal to allow the compressed gas to escape from the cylindrical body and flow through said neck into the inflatable portion of the bedpan. The piercing means includes a guide collar shaped and dimensioned to enclose and slide along at least a portion of the outer wall of the cylindrical body and an elongate pin having a pair of ends, one of the ends being carried by the guide collar and the other of the ends being positioned adjacent the seal in the neck of the compressed gas container. The pin and guide collar are shaped and dimensioned such that the end of the pin adjacent the seal in the neck can be readily manually pushed toward and through the seal to allow compressed gas contained in the container to escape therefrom through the neck and to flow into the inflatable portion of the bedpan. The guide collar slides along the cylindrical wall of the container when the pin is pushed through the seal.

Turning now to the drawings, which depict the presently preferred embodiment of the invention for the purpose of illustrating the practice thereof and not by way of limitation of the scope of the invention, and in which like reference characters identify corresponding elements throughout the several views, FIGS. 1-5 illustrate the presently preferred embodiment and best mode of the invention including a closed, ring-shaped, flexible, inflatable portion generally identified by reference character 11 and having a first end 12 which is generally positioned under the sacrococcygeal area of a bedfast patient and a second end 13 which is normally located beneath the upper leg areas of the patient. For purposes of clarity, each of the drawings illustrates an inflated bedpan. Inflated ring-shaped portion 11 encloses and defines a central interior area 14 which is spanned by a fluid impervious flexible panel 15 connected to ring-shaped inflated portion 11. Compressed gas canister 17 is maintained in position against end 13 of inflated tubular member 11 by cover sheet 16. The peripheral edge of cover sheet 16 is glued or otherwise secured along its perpheral edge to end 13 of flexible, elastic, inflated ring 11. Canister 17 includes a hollow body having cylindrical wall 18 provided with hollow neck 19. Seal 20 in the hollow of neck 19 prevents compressed gas from escaping from canister 17. Interior surfaces 21, 22 of cylindrically shaped guide collar 23 respectively slidably engage cylindrical wall 18 and neck 19 of canister 17. Pin 24 is fixedly carried by collar 23. Pin 24 is driven through seal 20 when a nurse or other medical attendant places the fingers of one hand on plastic 16 at end 10 of canister 17, places the thumb of the hand on plastic 16 at end 26 of collar 23 and applies compressive force as indicated by arrows F in FIG. 4 to canister 17. Constructing pin guide collar 23 so that is contacts the cylinder 17 at two separate points, i.e., cylinder wall 18 and neck 19, greatly minimizes the probability that collar 23 and pin 24 will be skewed when a medical attendant grasps and compresses ends 10, 26 of the inflating mechanism. This insures that pin 24 will be driven directly into seal 20 and that the longitudinal axis of the pin will remain parallel to the longitudinal axis 25 of cylinder 25. In FIG. 4, line 25 also represents the longitudinal axis of pin 24 and collar 23. Maintaining the co-linear relationship of the longitudinal axes of pin 24, collar 23 and canister 17, while pin 24 is pushed through seal 20, is critical because any tilting or skewing of guide collar 23 increases both the frictional force between collar surfaces 21, 22 and the compressive force F required to force pin 24 into and through seal 20. In the preferred embodiment of the invention, the diameter of pin 24 is relatively small so that only a minimal amount of force is required to drive the pin through seal 20.

Gas released from canister 17 when pin 24 pierces seal 20 flows through aperture 28 in collar 23 and through aperture 29 of wall 30 (FIG. 2) into inflatable portion 11 of the bedpan. Surface 27 of guide collar 23 contacts canister 17 as pin 24 pierces seal 20 to control the depth of penetration of pin 24.

Utilization of a pin 24 having a relatively small diameter reduces the rate of flow of gas from canister 17 so that a patient is only gradually raised from the surface of his bed during inflation of the bedpan. Another reason for reducing the rate of flow of gas from canister 17 is that gas rapidly flowing from canister 17 and striking the plastic wall of the bedpan can actually freeze a portion of the plastic. This embrittles the plastic and causes the wall of the bedpan to rupture.

Tab 35 is attached to area 36 of bottom panel 15. Area 36 is defined and circumscribed by a series of small cuts 37 made in panel 15. Cuts 37 partially penetrate panel 15 so that when tab 35 is pulled away from panel 15, panel 15 tears along circular cut line 38.

As indicated in FIGS. 6 and 7, the bedpan may be formed with an auxiliary tab 45 at end 12 (or end 13) of the bedpan along with partially penetrating cut 46 made in wall 47 of end 12. When tab 45 is pulled in the direction of arrow A, wall 47 tears along cut 46 allowing the pressurized gas to escape from the bedpan.

In use, the uninflated bedpan is removed from its package and pushed underneath a bedfast patient so that end 12 is generally underneath the posterior of the patient and end 13 is beneath the legs of the patient. When the uninflated bedpan is properly positioned beneath the patient, pouch 16 is generally located between the legs of the patient and can readily be reached by an attendant or, depending on the well-being of the patient, by the patient. Since the bedpan is not inflated when it is not positioned beneath the patient, and since canister 17 is not positioned beneath the patient, the patient only needs to be moved a minimal amount in order to position the bedpan underneath his body. In fact, in many cases, an attendant can manually slip the bedpan between the pateint and the sheet without having to move the patient. After the bedpan is properly positioned, pouch 16 is compressed as indicated by arrows F in FIG. 4 to inflate the bedpan. In the presently preferred embodiment, the relatively small diameter of pin 24 slows the rate of flow of gas from canister 17 after seal 20 has been punctured so that the patient is gradually raised from the surface of the bed during inflation of the bedpan.

The ability of a medical attendant to readily locate canister 17, either visually or through tactile sensation, after te uninflated bedpan has been positioned beneath a patient markedly simplifies the use of the bedpan and, in many cases, spares a seriously injured patient the pain asssociated with the positioning of a bedpan.

As would be appreciated by those of skill in the art, canister 17 or some other gas producing mechanism could be located inside inflatable portion 11 apart from the manually operable mechanism for activating the same.

Having described may invention in such terms as to enable those skilled in the art to understand and practice it, and having identified the presently preferred embodiments and best mode thereof, I claim:

1. A disposable, self-inflating bedpan comprising (a) a closed, generally ring-shaped, flexible and inflatable portion constructed from a fluid imprevious material to produce a curved, pan-shaped configuration when said portion is inflated, said ring-shaped portion enclosing and defining an interior area and having (i) a first end generally positioned under the sacrococcygeal area of a bedfast patient, and (ii) a second end generally positioned beneath and spanning any space between the upper leg areas of said bedfast patient, said material having an exterior surface area, (b) a fluid impervious flexible panel connected to said ring-shaped portion and spanning said interior area thereof such that when said ring-shaped portion is inflated a self-supporting fluid-tight reservoir having a continuous upstanding wall for collecting and retaining bodily excrement is formed, (c) manually activated means positioned adjacent said exterior surface of said material of said second end and outside of said interior area of said ring-shaped portion of said bedpan for producing gas for inflating said ring-shaped portion of said bedpan, said inflating means generally being positioned on said exterior surface of said second end such that said inflating means can be readily reached and manually activated by a medical attendant after said bedpan is positioned beneath said bedfast patient, and gas released when said inflating means is manually activated flows into said ring-shaped portion to inflate the same.

2. The apparatus of claim 1 wherein said inflating means includes (a) a compressed gas container positioned adjacent said exterior surface of said second end and including (i) a hollow body having a generally cylindrical outer wall and containing pressurized gas, and (ii) a generally circular hollow neck connected to and in fluid communication with said cylindrical body and having an outer wall, and a seal formed in the hollow thereof to prevent said pressurized gas from escaping from said cylindrical body through said neck, and (b) sleeve means for manually piercing said seal to allow said compressed gas to escape from said cylindrical body and flow through said neck and into said inflatable portion, said sleeve means including (i) a guide collar shaped and dimensioned to enclose and simultaneously slide along at least a portion of both said outer wall of said cylindrical body and of said neck, and (ii) an elongate pin having a pair of ends, one of said ends being carried by said guide collar, and the other of said ends being positioned adjacent said seal in said neck of said compressed gas container, said pin and said guide collar being shaped and dimensioned such that said end of said pin adjacent said seal in said neck can be readily manually pushed toward and through said seal to allow compressed gas contained in said container to espace therefrom through said neck and flow into said inflatable portion, said guide collar sliding along said cylindrical wall and said neck wall of said container as said pin is pushed through said seal.

3. The apparatus of claim 2 wherein said pin and seal are shaped, contoured and dimensioned such that when said pin is pressed through said seal said bedpan gradually inflates to minimize discomfort to a patient during said inflation of said bedpan.

4. The apparatus of claim 2 wherein said inflating means is maintained on said second end of said bedpan such that a medical attendant can tactilely locate, grasp and compress said inflating means between the thumb and finger of a hand in order to displace said sleeve means and force said needle through said seal.

5. The apparatus of claim 3 wherein (a) said fluid impervious material comprises a plastic, said material and said inflating means being positioned adjacent one another such that gas leaving said compressed gas cylinder when said needle pierces said seal contacts a portion of said material, and (b) said sleeve means is shaped, contoured and dimensioned such that when said needle pierces said seal, said needle travels through a selected distance and is prevented from being manually forced through a distance greater than said selected distance, said selected distance through which said needle travels causing said needle to pierce said seal such that gas escapes from said compressed gas container at a gradual rate which avoids cooling and embrittlement of said portion of said plastic contacted by said escaping gas.

6. The apparatus of claim 5 wherein (a) a supplementary portion of said material is attached to said ring-shaped portion and at least partially envelops and maintains said compressed gas container adjacent said second end of said ring-shaped portion, and (b) an aperture is formed in said sleeve means such that gas escaping through said pierced seal of said container passes immediately into and through said aperture against a part of said supplementary portion of material.

* * * * *